United States Patent [19]

Striegler et al.

[11] 3,986,557

[45] Oct. 19, 1976

[54] PRODUCTION OF BITUMEN FROM TAR SANDS

[75] Inventors: John Howard Striegler, Richardson; Eddie Paul Howell, Plano, both of Tex.

[73] Assignee: Atlantic Richfield Company, Los Angeles, Calif.

[22] Filed: June 6, 1975

[21] Appl. No.: 584,517

[52] U.S. Cl. ..... 166/272; 166/50; 166/303

[51] Int. Cl.[2] ..... E21B 7/04; E21B 43/24

[58] Field of Search ..... 166/256, 259, 272, 271, 166/281, 285, 288, 303, 50, 52; 175/62

[56] References Cited

UNITED STATES PATENTS

| | | | |
|---|---|---|---|
| 2,271,005 | 1/1942 | Grebe | 166/50 X |
| 2,584,605 | 2/1952 | Merriam et al. | 166/272 X |
| 2,778,603 | 1/1957 | McCune et al. | 166/50 X |
| 2,974,937 | 3/1961 | Kiel | 166/272 X |
| 3,285,350 | 11/1966 | Henderson | 175/62 X |
| 3,338,306 | 8/1967 | Cook | 175/62 X |
| 3,386,508 | 6/1968 | Bielstein et al. | 166/272 |

*Primary Examiner*—James A. Leppink
*Assistant Examiner*—George A. Suchfield
*Attorney, Agent, or Firm*—Ronnie D. Wilson

[57] ABSTRACT

A method of producing bitumen from a subterranean tar sand formation characterized by the following muti-step process. First, a continuous wellbore having a second section thereof contained within the formation and a first and a third section extending said second section to the earth's surface is formed. Next, a perforated liner is inserted into the wellbore extending the entire length thereof and having perforations so positioned thereon to be adjacent the second section of the wellbore. Thereafter, a heated fluid is circulated through the wellbore, contacting the formation via the perforations, thereby reducing the viscosity of the bitumen contained therein rendering it mobile. Subsequently, the mobilized bitumen is recovered via the wellbore.

1 Claim, 1 Drawing Figure

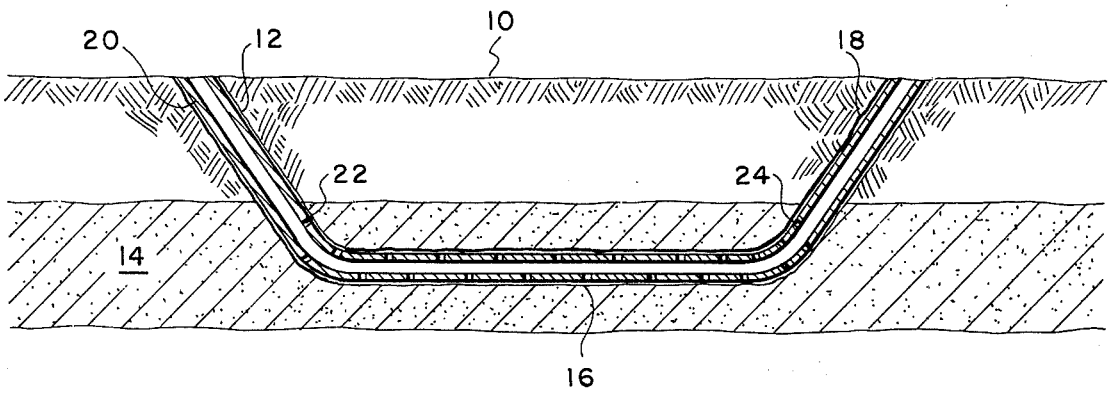
20
12
10
18
22
24
14
16

PRODUCTION OF BITUMEN FROM TAR SANDS

The present invention relates to the recovery of bitumen from a subterranean tar sand formation by means of fluid drive. More particularly it is concerned with the recovery of bitumen by steam injection via a horizontal wellbore within the formation. The steam serves both as a driving agent to force the bitumen to the production well and as a viscosity lowering agent to mobilize the bitumen over a substantial portion of the formation.

Large deposits of petroleum exist in the world which cannot be produced efficiently by conventional methods because of their extremely high viscosity. Such deposits include the Athabasca tar sands in Canada, the Jobo region in Venezuela, and the Edna and Sisquoc regions in California. In the Athabasca region alone upwards of 1500 billion barrels of oil may be present. Only a small portion of these tar sands are recoverable by surface mining techniques. It is all too clear that if these energy values are to be recovered for this generation and those to come they must be recovered by in situ techniques. Various proposals have been set forth for recovering the petroleum of the type contemplated herein. Some have involved steam injection, in-place combustion, etc., but none have been very successful as yet. The well-known huff-and-puff process, for recovering petroleum in which steam is injected into a formation for a period of time after which the steam-saturated formation is allowed to soak for an additional interval prior to placing the well on production, has too much of a time lapse before production is obtained. One of the principle reasons for the lack of success of previously attempted steam injection techniques for recovering bitumen from a tar sand formation has been the difficulty in providing a permeable, competent communications path or zone connecting injection wells and production wells. The present invention provides a method for overcoming these previously encountered problems in recovering bitumen from tar sands.

It is therefore an object of our invention to provide a method for applying heat to a large volume of a subterranean tar sand formation while simultaneously forcing the bitumen of reduced viscosity from the formation to production. It is a particular object of the present invention to provide a method for recovering bitumen from a subterranean tar sand formation via a continuous wellbore in the formation. It is another object of the present invention to recover bitumen from a subterranean tar sand formation by circulating a heated fluid through a continuous wellbore having a perforated liner therein, said wellbore having both end portions thereof extending to the surface.

These and other objects will become apparent from the descriptive matter hereinafter, particularly when taken in conjunction with the accompanying FIGURE.

In accordance with the present invention, bitumen is recovered from a subterranean tar sand formation by the following multi-step method. First, a continuous wellbore having a second section thereof contained within the formation and a first and a third section extending said second section to the earth's surface is formed. Next, a perforated liner is inserted into the wellbore extending the entire length thereof and having perforations so positioned thereon to be adjacent the second section of the wellbore. Thereafter, a heated fluid is circulated through the wellbore, contacting the formation via the perforations, thereby reducing the viscosity of the bitumen contained therein rendering it mobile. Subsequently, bitumen mobilized by the heated fluid is recovered via the wellbore.

The FIGURE illustrates a vertical section of a subterranean tar sand formation penetrated by a continuous wellbore having both ends thereof extending to the surface.

Referring to the FIGURE, the drawing shows the earth's surface 10 from which a wellbore having a first section 12 has been drilled by well-known means to penetrate a subterranean tar sand formation 14 and having a second section 16 extending therethrough and turning upward at third section 18 to the earth's surface. Continuous liner 20 having perforations located between points 22 and 24 is shown extending the entire length of the wellbore.

In carrying out an embodiment of the present invention and referring to the FIGURE, we have a continuous wellbore having first and third sections 12 and 18 and second section 16 penetrating the subterranean tar sand formation 14. Initially, first section 12 is drilled to penetrate the tar sand formation 14 and then second section 16 is extended a suitable distance within said formation 14 and, subsequently, turned upward at third section 18 to contact the earth's surface. After completion of drilling, the drill bit is removed and the liner having perforations between points 22 and 24 is positioned inside the drill string. Circulation of a heated fluid such as steam or hot water is begun and the drill pipe is removed leaving the perforated liner in place. As the heated fluid is circulated through the continuous wellbore having the perforated liner positioned therein, fluid communication with said formation via said perforations permits the temperature of the tar sand to be raised and the bitumen contained therein rendered mobile. The mobilized bitumen is recovered via said wellbore through the perforations by the driving force of the circulating heated fluid. In the operation of the present invention, care should be taken in correlating the fluid flow rate and the rate at which the fluid temperature is raised above the reservoir temperature so that an adequate rate of flow is maintained at pressures that remain below the fracturing pressure of the formation.

The diameter and length of the continuous wellbore is not critical and will be determined by conventional drilling criteria, the characteristics of the specific formation, and the economics of a given situation. However, in order to best exploit the effects of gravity in recovering the bitumen, the second section of the wellbore should be formed near the bottom of the tar sand formation. The liner's composition and perforation size is a function of factors such as type of injected fluid, flow rate, temperatures and pressure employed in a specific operation.

Having thus described the invention, it will be understood that such description has been given by way of illustration and not by way of limitation, reference for the latter purpose being had to the appended claims.

Therefore, we claim:

1. Method for recovering bitumen from a subterranean tar sand formation containing viscous bitumen which comprises:

drilling with a drill pipe and bit a continuous wellbore having a second section contained within said formation and a first and third section extending said second section to the earth's surface;

inserting a perforated liner within said wellbore by removing said drill bit, positioning said liner inside said drill pipe, removing said drill pipe leaving said liner in position, and extending the entire length of said wellbore and said perforations located in the portion adjacent said second section of said wellbore providing fluid communication with said formation, circulating a heated fluid through said wellbore contacting said formation via said first section and thereby reducing the viscosity of said bitumen contained therein rendering same mobile; and recovering said mobilized bitumen via said third section of said wellbore.

* * * * *